United States Patent [19]

Theurer

[11] 4,064,807

[45] Dec. 27, 1977

[54] MOBILE APPARATUS FOR NON-STOP TRACK LEVELING AND BALLAST TAMPING

[75] Inventor: Josef Theurer, Vienna, Austria

[73] Assignee: Franz Plasser Bahnbaumaschinen Industriegesellschaft m.b.H., Vienna, Austria

[21] Appl. No.: 689,993

[22] Filed: May 26, 1976

[30] Foreign Application Priority Data

Aug. 18, 1975 Austria ..... 6395/75

[51] Int. Cl.[2] ..... E01B 29/04

[52] U.S. Cl. ..... 104/7 A; 37/104

[58] Field of Search ..... 104/7 R, 7 A, 7 B, 12; 37/104, 105, 106, 107; 171/16

[56] References Cited

U.S. PATENT DOCUMENTS

| | | | |
|---|---|---|---|
| 1,533,198 | 4/1925 | Mann | 37/105 |
| 3,013,616 | 12/1961 | Plasser et al. | 171/16 |
| 3,731,409 | 5/1973 | Schenkir et al. | 104/12 X |
| 3,811,382 | 5/1974 | Buchter et al. | 104/12 X |
| 3,871,299 | 3/1975 | Plasser et al. | 104/7 B |
| 3,926,123 | 12/1975 | Plasser et al. | 104/12 X |

FOREIGN PATENT DOCUMENTS

| | | | |
|---|---|---|---|
| 677,923 | 8/1952 | United Kingdom | 171/16 |

*Primary Examiner*—Robert J. Spar
*Assistant Examiner*—Randolph A. Reese
*Attorney, Agent, or Firm*—Kurt Kelman

[57] ABSTRACT

In a non-stop track leveling and ballast tamping apparatus wherein a machine frame is continuously advanced along a track as successive track sections are lifted for leveling under the control of a reference system, a plow is arranged to move ballast onto the ballast bed below the lifted track sections so that there are formed two elongated raised ballast strips below the track rails and an intermediate strip recessed between the two raised strips. A ballast compactor comprises a chassis supporting a vibrator generating at least approximately horizontal vibrations and a hydraulic load. The chassis has rail engaging and guiding rollers associated with each rail and mounting the chassis for mobility on the track and pressure fluid operated cylinders for continuously laterally pressing the rollers without play against the rail with which it is associated.

9 Claims, 4 Drawing Figures

MOBILE APPARATUS FOR NON-STOP TRACK LEVELING AND BALLAST TAMPING

The present invention relates to improvements in a mobile apparatus for continuously leveling a track and compacting ballast of a ballast bed supporting the track consisting of two rails fastened to ties resting on the ballast. More particularly, it relates to an apparatus which comprises a frame mounted on the track for continuous advancement therealong during the leveling and ballast compaction, a reference system controlling the track leveling, a roller unit mounted on the frame for lifting a section of the track, plow means mounted on the frame for moving ballast onto the ballast bed below the lifted track section and for leveling the said ballast, and a ballast compacting means mounted rearwardly of the plow means in the direction of advancement, the ballast compacting means comprising means for imparting vibrations to the track and hydraulic load means associated therewith for simultaneously exerting pressure on both rails of the track section in the direction of the leveled ballast bed whereupon the track section rests.

It has been proposed to compact the ballast bed on which a track rests by imparting to the track a sufficient vertical force. In one procedure of this type, ballast is moved laterally inwardly under the ties of a lifted track section, the ballast is leveled across the width of the track bed, the track is then lowered to rest on the leveled ballast bed, and a vertical vibration is imparted to the lowered track to compact the ballast thereunder. This method has not been used in practice because it has not been possible to obtain sufficient ballast compaction over the relatively large leveled ballast area supporting the track, compared with the conventional tamping of ballast at the intersections of the ties and rails by reciprocatory vibratory tamping tools. Furthermore, the proposed laterally arranged plows in this known apparatus are not capable of properly moving and leveling ballast under the lifted track rails since their wedge-shaped leveling plates are arranged in front of the plowshares in the working direction so that the plows cannot uniformly move and distribute the ballast under the track rails nor can they level the ballast under the rails.

It is the primary object of this invention to provide a mobile track leveling and tamping apparatus of the indicated type which provides an effective ballast support for the track rails and makes it possible to impart acceptable ballast compaction in a commercially practicable non-stop operation.

The above and other objects are accomplished in accordance with the invention with a plow means comprising plow elements arranged to move the ballast so that there are formed two elongated raised ballast strips below the track rails for support of the ties in the region of the rails and an elongated intermediate strip between the two raised ballast strips, the intermediate strip being recessed. This plow means is combined with a ballast compacting means which comprises a chassis supporting a means for generating at least approximately horizontal vibrations and hydraulic load means associated therewith for simultaneously exerting pressure to both rails of the track section in the direction of the leveled raised ballast strips whereupon the track section rests. The chassis has rails engaging and guiding means associated with each of the rails and mounting the chassis for mobility on the track, and pressure fluid operated means for continuously laterally pressing the rail engaging and guiding means without play against the rail with which it is associated.

With such a plow arrangement, the two raised ballast strips support the ties and tie riding is avoided, the ballast compaction being limited to these relatively narrow strips under the rails. The ballast compaction is very efficiently produced by the specific compacting means, as has been more fully described and claimed in my copending U.S. patent application Ser. No. 644,638, filed Dec. 29, 1975, entitled "Track Surfacing Apparatus". Since the intermediate ballast bed strip is recessed, no compaction of continued downward pressure exerted by movement of heavy trains over the surfaced track will ever raise the level of the ballast bed between the rails above that of the ballast bed under the rails or the tie ends. This is important to avoid tie riding. Furthermore, the compaction means can effectively compact the ballast in the relatively narrow strips forming the actual track support. In this manner, the combination of the specific plow means and ballast compaction means for the first time makes it possible effectively and commercially acceptably to compact ballast in a non-stop track leveling operation to provide a high-quality support for the leveled track. This non-stop operation has an advantage over conventional intermittently proceeding track leveling and tamping operations in that the track compaction is much more uniform and also is much faster.

The above and other objects, advantages and features of the present invention will become more apparent from the following detailed description of a now preferred embodiment, taken in conjunction with the accompanying schematic drawing wherein FIG. 1 is a side elevational view of a mobile apparatus for continuously leveling a track and compacting ballast;

Figure 1:
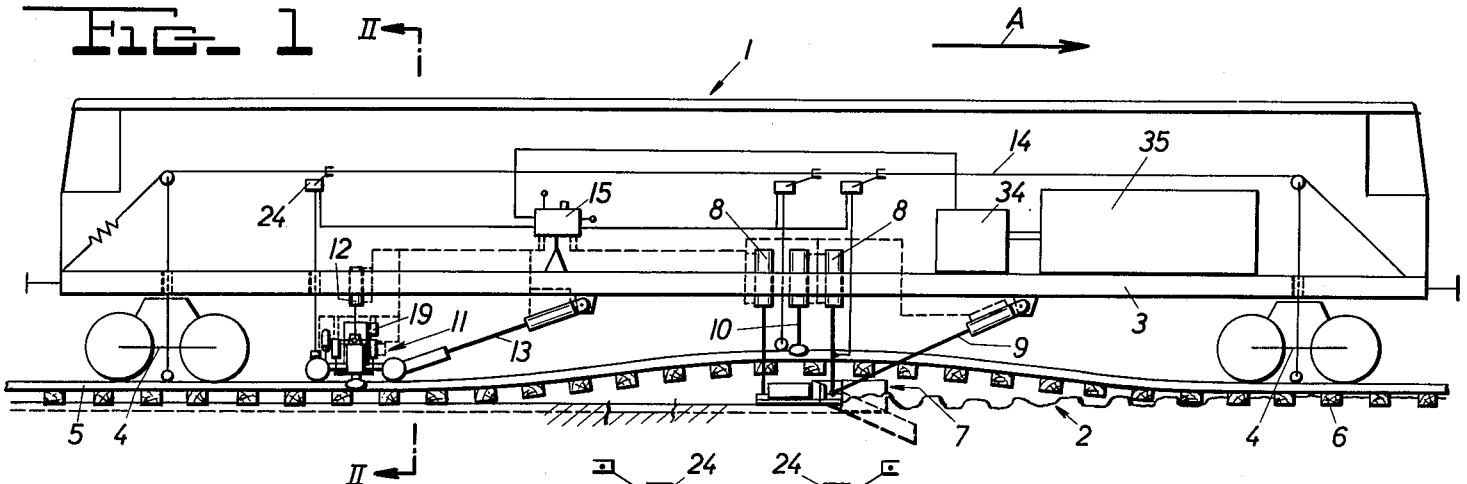

Referring now to the drawing and first to FIG. 1, there is shown a generally conventional mobile track tamping and leveling machine 1 designed for leveling and tamping a track consisting of two rails 5, 5 fastened to ties 6 resting on ballast 2. As is well known and need not be described in detail herein, this machine comprises elongated frame 3 mounted on undercarriages 4, 4 for continuous advancement in the direction of arrow A along the track during the leveling and ballast compaction. Reference system 14 controls the track leveling and roller unit 10 is mounted on frame 3 intermediate the undercarriages for lifting a section of the track. All of these structures and their operation are conventional. Plow means 7 is mounted on the frame in the region of the track lifting unit. The plow means is vertically adjustable by hydraulic drives 8 and the plow elements may be longitudinally adjusted by hydraulic drives 9 whose piston rods extend generally in the direction of the track. Ballast compaction means 11 is mounted on frame 3 rearwardly of plow means 7 in the direction of advancement adjacent rear undercarriage 4. Hydraulic load means 12 and longitudinally adjustable hydraulic drive 13 link the compaction means to the apparatus frame. As schematically shown, frame 3 also carries a hydraulic fluid reservoir 34 connected to a hydraulic circuit for delivering fluid to all the hydraulic drives and a drive 35 for propelling the apparatus along the track. All these drives may be controlled from a central panel 15 where an operator observes and controls the entire leveling and tamping operation.

Figure 2:
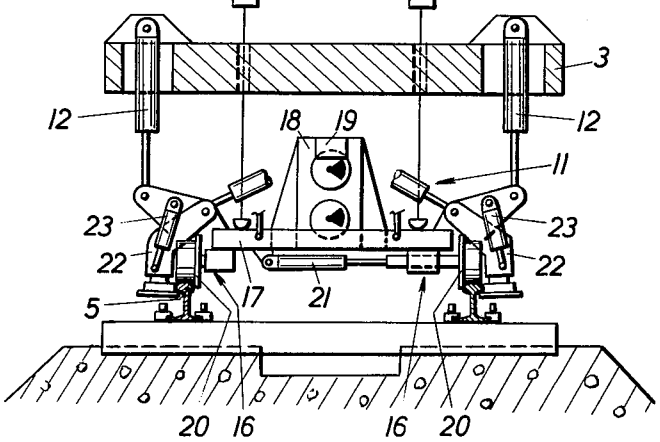
FIG. 2 is a transverse section along line II—II of FIG. 1, showing an end view of the ballast compacting means.

FIG. 2 shows the ballast compaction means on an enlarged scale, such means being described in more detail and claimed in my above-mentioned copending application. The ballast compaction means comprises chassis 17 having rail engaging and guiding means 16 associated with each rail 5 and mounting the chassis for mobility on the track. Hydraulic load means 12 is linked to the chassis, each hydraulic load means consisting of a cylinder-and-piston drive whose ends are respectively pivoted to frame 3 and chassis 17 for exerting pressure to both rails in a generally vertical direction. The chassis carries vibrators 18 for generating at least approximately horizontal vibrations, hydraulic drive 19 rotating the eccenters of the vibrators to generate the desired vibrations. The magnitude of the horizontal vibration components may be adjusted by changing the weight and/or the position of the eccenters, and/or the rotary speeds thereof to adapt the apparatus to local ballast conditions.

Effective transmission of the vibrations to the track is assured by holding chassis 17 without play on the track rails. For this purpose, the rail engaging and guiding means of the chassis include flanged wheels 20 cooperating with flanged wheels 22 holding the heads of rails 5, 5 therebetween. Hydraulic drive 21 presses flanged wheels 20 against the inside of the rail heads while hydraulic drives 23 pivot flanged wheels 22 against the outside of the rail heads so as to hold the track rails without play therebetween. In this manner, the horizontal vibrations will be transmitted to the track without shock so as to avoid damage to the rail fasteners and produce effective compaction of the ballast under ties 6 by pressing the ties into the leveled ballast strips formed by plow 7.

Sensors 24 are supported on frame 3 and associated with ballast compaction means 11 for producing signals indicating the vertical position of the compaction means during operation and of the track in relation to reference system 14. To avoid compaction of the ballast bed intermediate the rails in the region of the centers of the ties, plow 7 is arranged in the manner illustrated in FIGS. 3 and 4 to impart to ballast bed 5 the cross sectional profile shown in FIG. 2.

The illustrated plow comprises substantially V-shaped intermediate ballast plow 25 mounted intermediate the track rails to excavate the intermediate strips during the advancement of frame 3 and simultaneously to move the excavated ballast towards respective rails 5, 5, and plowshare 26, 26 extending from intermediate plow 25 towards the rails for leveling the moved ballast and form two raised ballast strips. In this arrangement, only the intermediate plow actually plows the ballast while the laterally extending plowshares serve primarily to distribute and level the ballast. The arrangement is relatively simple and assures centering of the plow on the ballast bed during during the operation of the machine.

Figure 3:
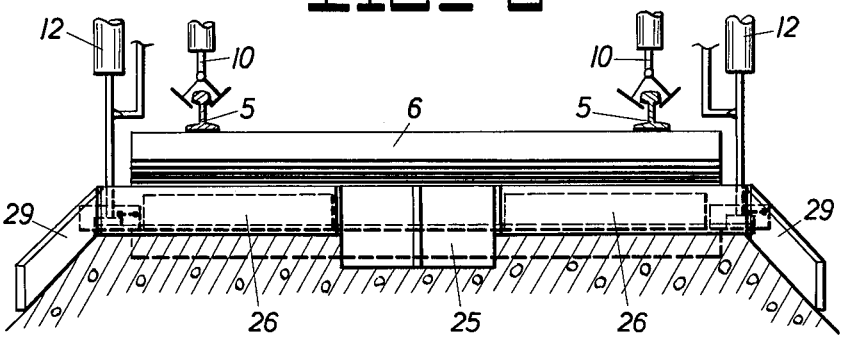
FIg. 3 is a section along line III—III of FIG. 4, showing an end view of the plow means.
Figure 4:
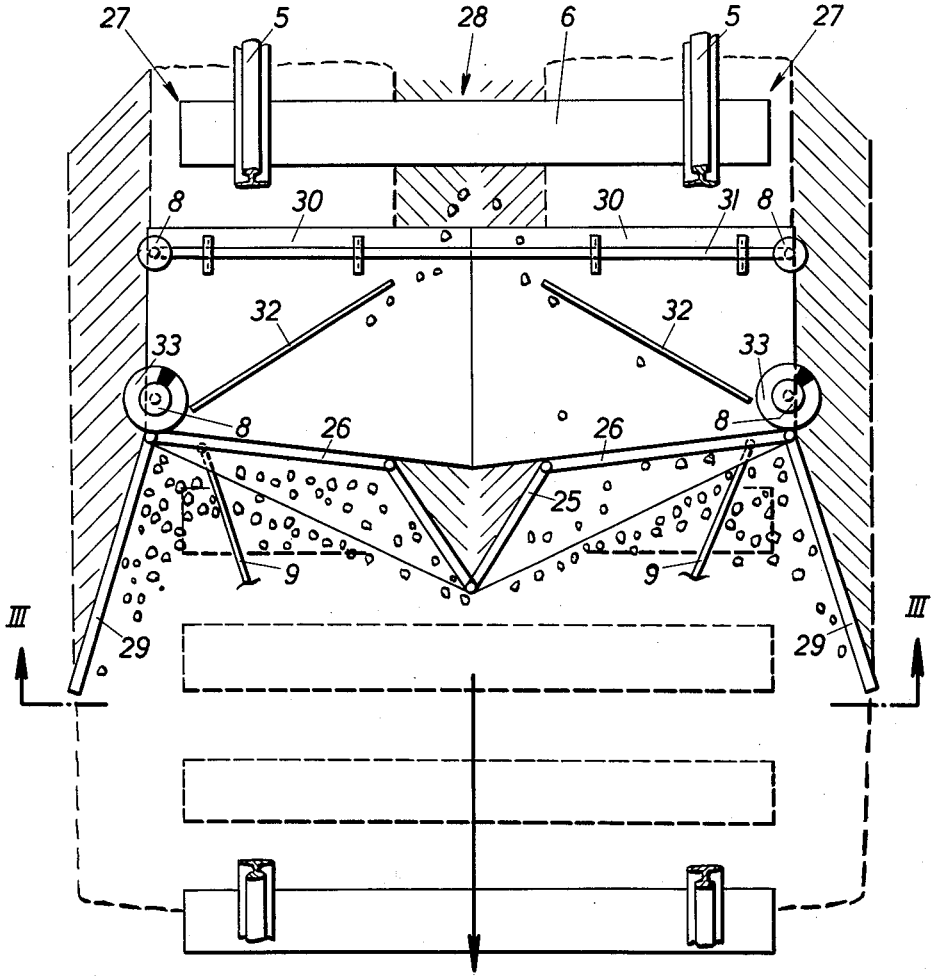
FIG. 4 is a top view of the plow means, with a partial view of the track.

To obtain the central recess in the ballast bed, the lower edges of V-shaped plow 25 and leveling plowshares 26, 26 are vertically spaced from each other, as shown in FIG. 3, to produce leveled raised ballast strips 27, 27 below the track rails and extending in the track direction, elongated recessed ballast strip 28 being left between the raised strips. Additional plowshares 29, 29 are mounted at the outer ends of leveling plowshares 26, 26 for moving ballast from a region of the ballast bed beyond the ends of ties 6 inwardly towards the rails to supply additional ballast to the raised strips 27, 27. As shown, plow means elements 25, 26, 29 are hinged together and, if desired, the hinged connections may be detachable. Means for fixing the plowshares into desired pivotal positions may be provided so that their positions may be adjusted in relation to the prevailing ballast conditions. As shown, the piston rods of hydraulic drives 9 are linked to plowshares 26, 26 for adjusting the position of these plow elements. If plowshares 26 and 29 are fixedly interconnected to form lateral plow units, it will be useful to make at least the connection between plowshares 26 and plow 25 detachable or to interconnect the two parts of the V-shaped plow at the center of the track detachably so as to facilitate the assembly and disassembly of the plow means. If the elements of the plow means are detachably interconnected at the track center to form to like halves, horizontal leveling plates 30, which adjoin the plow means elements, may advantageously carry at their trailing ends transversely extending connection member 31 designed to hold the two plow means halves together in the assembled condition shown in FIG. 4. The leveling plates carry two obliquely extending baffles 32, 32 to guide any ballast spilling over the upper edges of plowshares 26 to the intermediate recessed ballast bed strip 28. This prevents such spilled-over ballast to be placed on the leveled raised ballast strips 27, 27, thus disturbing the grade of these track supports. If desired, cover plates may be mounted on the upper edges of plow 25 and plowshares 26 to prevent any spill-over of ballast.

If desired, intermediate plow 25 could be eliminated and raised ballast strips 27, 27 may be formed merely by cooperation of plowshares 29 and 26, in which case the plowshares must be so dimensioned as to leave central region 28 of the ballast bed free from receiving ballast moved by plowshares 29 inwardly so as to form a recessed strip between the raised strips. However, the illustrated arrangement is preferred since it will move ballast outwardly from the excavated center and inwardly from the ballast bed flanks to form the two raised track supporting ballast strips. By suitably raising or lowering the plow elements by means of drives 8 and adjusting the positions of the plowshares by drives 9, it is possible to make all desired adjustments in respect of the extent of the central ballast excavation and/or the ballast build-up under the rails. The illustrated plow arrangement has the further advantage of requiring a very limited height fo the plow elements.

The effectiveness of the plow means will be increased by imparting vibrations thereto. For this purpose, eccenter drives 33 are mounted on the plow means 7 so as to shake the plow elements. Depending on whether the ballast bed is badly encrusted and/or it is desired to impart additional density to the raised ballast strips before their full compaction, drives 33 are adjusted to change the magnitude of plow vibrations. The four vertical drives 8 may be operated in response to the signals from sensor 24 to adjust the vertical position of plow means 7 in response to the ballast compaction.

If desired and advantageously, additional hydraulic drives may connect the plow means elements to frame 3 for laterally moving the plow means elements, for instance during assembly or disassembly and/or in track curves so as to conform the extension of raised ballast strips 27, 27 to the curves. Furthermore, V-shaped plow 25 may be adjusted to change the width of the excavated center strip and the width of plowshares 26, 26 may be adjustable to change the width of raised strips 27, 27.

The operation of the hereinabove described apparatus will partly be obvious from the illustrated structure and will be further explained hereinbelow by way of example:

As the machine advances non-stop in the direction of arrow A, roller unit 10 will lift successive track sections and the track will drop back to a graded level controlled by reference system 14 and determined by the grade of the two elongated raised ballast strips 27, 27 formed by plow means 7, as these ballast strips are compacted by compacting means 11. The signals from sensor 24 control the grade of the ballast strips 27 and 28 on the basis of reference system 14. If desired, the vertical level of intermediate plow 25 and plowshares 26, 26 may be independently adjustable to conform to given track conditions. Also, as indicated, it is possible to dispense entirely with any intermediate plow and merely to leave a suitable space between the inner ends of plowshares 26. Suitable operation and control of the plow vibration from operating panel 15 will provide desired ballast densities in coordination with the extent of compaction provided by compacting means 11.

Depending on the ballast bed conditions, it may be desirable for the formation of uniformly compacted track support strips first to remove all ballast of the bed before surfacing to a desired depth and to deposit the removed ballast at the sides of the ballast bed for later displacement of this stored ballast inwardly under the track rails to form the raised ballast support strips.

Under all conditions, the raised ballast strips formed by plow means 7 are compacted by compacting means 11 under the control of reference system 14 to press the track and particularly the track ties into the compacted ballast strips 27, 27. Since a recessed strip remains between the support strips 27, 27, there is no danger of the track ties riding on a compacted center region of the ballast formed by inward displacement of ballast under the continuing loads of train traffic rolling thereover. The track will remain supported on a defined static system constituted by two supports carrying the track ties.

Obviously, the illustrated hydraulic drives could be replaced by spindle-and-nut drives, or by cable drives. The reference system may include reference lines including tensioned elongated elements or beams of radiation, such as light or laser beams. The plow means, too, may take various forms and shapes, as long as the plow elements are arranged to form two elongated raised ballast strips below the track rails and an elongated intermediate recessed strip between the two raised ballast strips. Furthermore, it would be possible to generate the horizontal vibrations by delivering pulsating streams of pressure fluid to the laterally extending hydraulic drives shown in FIG. 2, and to provide rail engaging and guiding means different from those illustrated therein.

What is claimed is:

1. In a mobile apparatus for continuously leveling a track and compacting ballast of a ballast bed supporting the track consisting of two rails fastened to ties resting on the ballast, which comprises a frame mounted on the track for continuous advancement therealong during the leveling and ballast compaction, a reference system controlling the track leveling, a roller unit mounted on the frame for lifting a section of the track, plow means mounted on the frame for moving ballast onto the ballast bed below the lifted track section and for leveling the said ballast, and a ballast compacting means mounted rearwardly of the plow means in the direction of advancement, the ballast compacting means comprising means for imparting vibrations to the track and hydraulic load means associated therewith for simultaneously exerting pressure to both rails of the track section in the direction of the leveled ballast bed whereupon the track section rests, the combination of 1. the plow means comprising plow elements for moving the ballast so that there are formed two elongated raised ballast strips below the track rails for support of the ties in the region of the rails and an elongated intermediate strips between the two raised ballast strips, the intermediate strip being recessed, and
2. the ballast compacting means comprising a chassis supporting a means for generating at least approximately horizontal vibrations and the hydraulic load means, the chassis having
   a. rail engaging and guiding means associated with each of the rails and mounting the chassis for mobility on the track, the vibration generating and load means being associated with the rail engaging and guiding means for simultaneously laterally vibrating and vertically loading each of the rail engaging and guiding means, and
   b. pressure fluid operated means for continuously laterally pressing the rail engaging and guiding means without play with respect to the chassis and against the rail with which it is associated.

2. In the mobile apparatus of claim 1, the plow elements comprising a substantially V-shaped intermediate ballast plow mounted intermediate the track rails to excavate the intermediate strip during the advancement of the frame and simultaneously to move the excavated ballast towards the respective rails, and a plowshare extending substantially transversely of the track from the intermediate ballast plow towards the rails for leveling the moved ballast and form the two raised ballast strips.

3. In the mobile apparatus of claim 1, the plow elements comprising a pair of plowshares mounted for moving ballast from a region of the ballast bed beyond the ends of the ties inwardly towards the rails, and a pair of additional plowshares extending substantially transversely of the track inwardly from the pair of ballast moving plowshares for leveling the moved ballast and form the two raised ballast strips.

4. In the mobile apparatus of claim 1, the plow elements comprising a substantially V-shaped intermediate ballast plow mounted intermediate the track rails to excavate the intermediate strip during the advancement of the frame and simultaneously to move the excavated ballast towards the respective rails, a pair of plowshares mounted for moving ballast from a region of the ballast bed beyond the ends of the ties inwardly towards the rails, and an additional plowshare extending substantially transversely of the track between the intermediate ballast plow and each of the ballast moving plowshares, the additional plowshares being connected to the plow and the ballast moving plowshares for leveling the moved ballast and to form the two raised ballast strips.

5. In the mobile apparatus of claim 1, means for imparting vibrations to the plow means.

6. In the mobile apparatus of claim 1, a drive for adjusting the magnitude of the horizontal vibrations associated with the vibration generating means.

7. In the mobile apparatus of claim 6, a sensor determining the density of the ballast compaction and a control responsive to the sensor for the drive.

8. In the mobile apparatus of claim 1, hydraulic drives associated with the plow means and the ballast compacting means.

9. In the mobile apparatus of claim 1, means for vertically adjusting the plow means, sensing means cooperating with the reference system for emitting a control signal, and the control signal operating the vertical plow adjusting means whereby the grade of the ballast strips is controlled in response to the reference system.

* * * * *